US010147568B1

(12) United States Patent
Yeh et al.

(10) Patent No.: US 10,147,568 B1
(45) Date of Patent: Dec. 4, 2018

(54) KEYBOARD DEVICE

(71) Applicant: Primax Electronics Ltd., Taipei (TW)

(72) Inventors: Tien-Yu Yeh, Taipei (TW); Che-Wei Yang, Taipei (TW); Chun-Yuan Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/811,639

(22) Filed: Nov. 13, 2017

(30) Foreign Application Priority Data

Jul. 14, 2017 (TW) ..... 106123679 A

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/705*** | (2006.01) |

(52) U.S. Cl.
CPC ..... *H01H 13/705* (2013.01); *H01H 2215/004* (2013.01)

(58) Field of Classification Search
CPC .. H01H 13/705; H01H 2215/004; H01H 3/00; H01H 3/02; H01H 3/12; H01H 13/00; H01H 13/14; H01H 13/26; H01H 13/50; H01H 13/52; H01H 13/70; H01H 2003/00; H01H 2003/02; H01H 2003/12; H01H 2233/00; H01H 2233/014
See application file for complete search history.

(56) References Cited

U.S. PATENT DOCUMENTS

| | | | | |
|---|---|---|---|---|
| 4,802,779 A * | 2/1989 | Allaire | H01H 3/122 400/490 |
| 5,757,292 A * | 5/1998 | Amro | G06F 3/0202 200/308 |
| 6,091,036 A * | 7/2000 | Hu | H01H 3/125 200/344 |

* cited by examiner

*Primary Examiner* — Anthony R. Jimenez
(74) *Attorney, Agent, or Firm* — Kirton McConkie; Evan R. Witt

(57) ABSTRACT

A keyboard device includes a base plate, a connecting element and a keycap. The connecting element is connected with a hook of the keycap and the base plate. The keycap includes an elastic structure, a first hooking part and a second hooking part. The elastic structure hook is installed on an inner surface of the keycap. The first hooking part is arranged beside a first side of the elastic structure. The second hooking part is arranged beside a second side of the elastic structure. While the connecting element is assembled with the keycap, the first hooking part and the second hooking part are pushed by the connecting element and the keycap is bent in response to the elasticity of the elastic structure. Consequently, the first hooking part is moved away from the second hooking part.

9 Claims, 6 Drawing Sheets

KEYBOARD DEVICE

FIELD OF THE INVENTION

The present invention relates to an input device, and more particularly to a keyboard device with plural key structures.

BACKGROUND OF THE INVENTION

Generally, the widely-used peripheral input device of a computer system includes for example a mouse device, a keyboard device, a trackball device, or the like. Via the keyboard device, characters or symbols can be directly inputted into the computer system. As a consequence, most users and most manufacturers of input devices pay attention to the development of keyboard devices. As known, a keyboard device with plural key structures is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed. The structures and the operations of the conventional key structure have been mentioned as above.

However, the conventional keyboard device 1 still has some drawbacks. For example, during the process of assembling the keycap 11 with the scissors-type connecting element 12, a hook 111 is firstly propped open by a connection shaft (not shown) of the scissors-type connecting element 12 and then the keycap 11 and the scissors-type connecting element 12 are combined together. Generally, the keycap 11 and the hook 111 are made of a plastic material. While the hook 111 is propped open, the structure of the hook is easily damaged. For example, a plastic pull-white problem possibly occurs or even the hook 111 is broken.

Therefore, there is a need of providing a keyboard device for reducing the possibility of damaging the keycap during the assembling process.

SUMMARY OF THE INVENTION

The present invention provides a keyboard device, wherein the keycap of the keyboard device is not easily damaged.

In accordance with an aspect of the present invention, there is provided a keyboard device. The keyboard device includes a base plate, a connecting element and a keycap. The connecting element is located over the base plate and connected with the base plate. The keycap is exposed outside the keyboard device and connected with the connecting element. The keycap includes an elastic hook that is connected with the connecting element. The elastic hook is made of an elastic material.

In an embodiment, the keycap is made of a plastic material, and the elastic hook is formed on an inner surface of the keycap through at least one of a double injection process, a high-frequency welding process and an ultrasonic hot welding process.

In accordance with another aspect of the present invention, there is provided a keyboard device. The keyboard device includes a base plate, a connecting element and a keycap. The connecting element is located over the base plate and connected with the base plate. The keycap is exposed outside the keyboard device and connected with the connecting element. The keycap includes an elastic structure, a first hooking part and a second hooking part. The elastic structure hook is installed on an inner surface of the keycap. The first hooking part is installed on the inner surface of the keycap and arranged beside a first side of the elastic structure. The first hooking part is contacted with the connecting element. The second hooking part is installed on the inner surface of the keycap and arranged beside a second side of the elastic structure. The second hooking part is contacted with the connecting element. The keycap is bent in response to elasticity of the elastic structure, so that the first hooking part is moved away from the second hooking part.

In an embodiment, the keycap is made of a plastic material, and the elastic structure is made of an elastic material, wherein the elastic structure is formed on the inner surface of the keycap through a double injection process.

From the above descriptions, the present invention provides a keyboard device. The keyboard device has an elastic hook or an elastic structure that is made of an elastic material. The elastic hook or the elastic structure is installed on an inner surface of a keycap. While the keycap is assembled with a connecting element, the elastic hook or the elastic structure is subjected to elastic deformation in response to the elasticity of the elastic hook or the elastic structure. Consequently, the structure of the keycap is not damaged.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a keyboard device.

Figure 1:
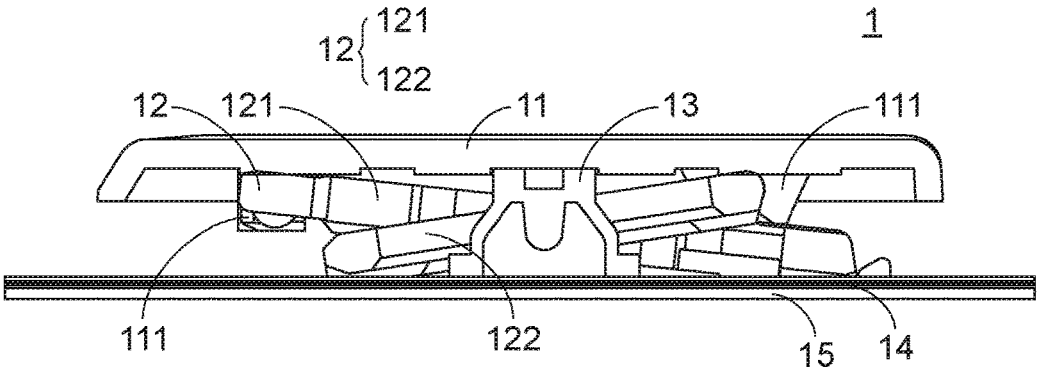
FIG.1 PRIOR ART
FIG. 1 is a schematic side cross-sectional view illustrating a conventional key structure.
Figure 2:
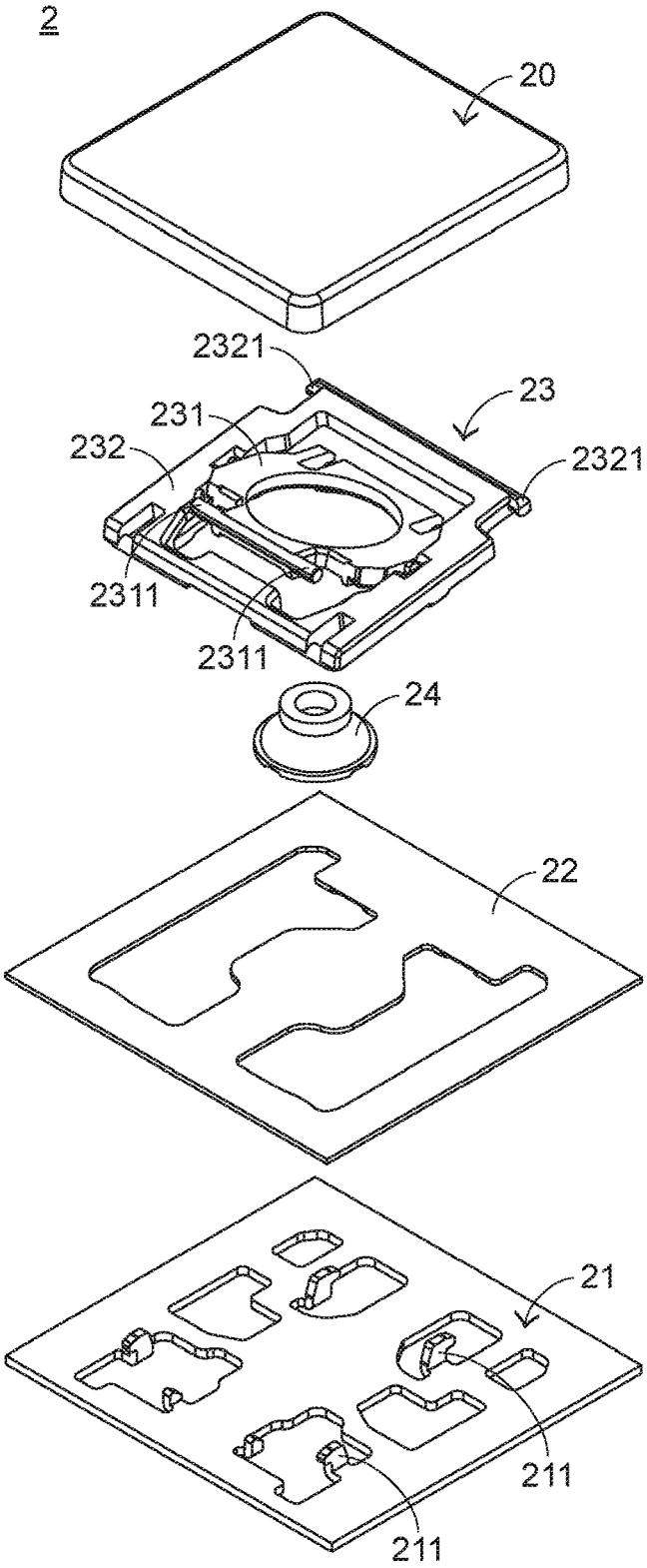
FIG. 2 is a schematic exploded view illustrating a portion of a keyboard device according to a first embodiment of the present invention.
Figure 3:
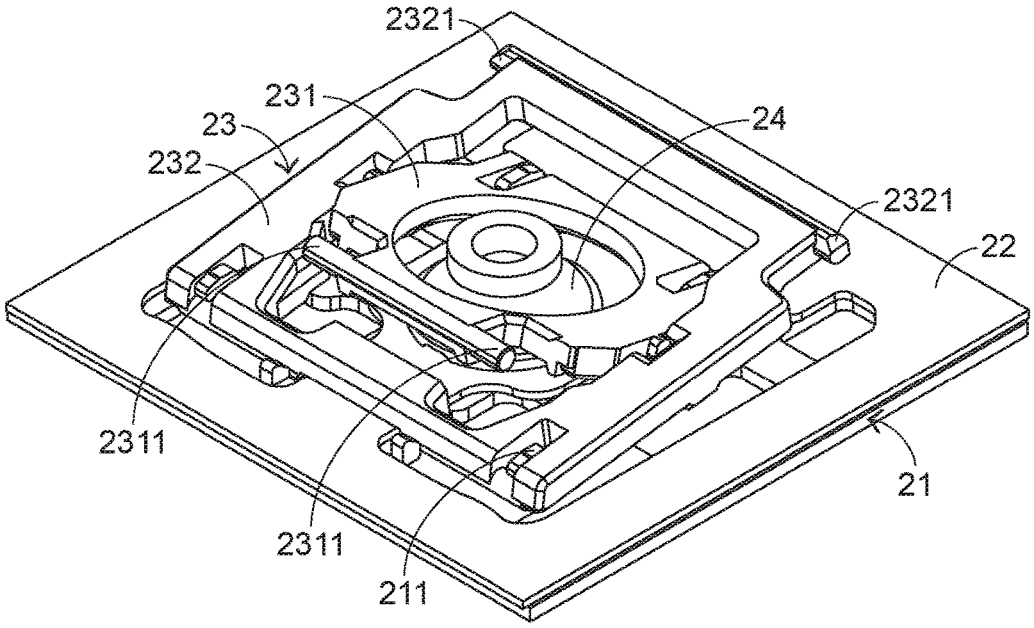
FIG. 3 is a schematic perspective view illustrating a portion of the keyboard device according to the first embodiment of the present invention.

The structure of a keyboard device of the present invention will be described with reference to FIGS. 2 and 3. FIG. 2 is a schematic exploded view illustrating a portion of a keyboard device according to a first embodiment of the present invention. FIG. 3 is a schematic perspective view illustrating a portion of the keyboard device according to the first embodiment of the present invention. In this embodiment, the keyboard device 2 comprises plural keycaps 20, a base plate 21, a switching circuit board 22, plural connecting elements 23 and plural elastic elements 24. For succinctness, only one keycap 20, one connecting element 23 and one elastic element 24 are shown in the drawings. The base plate 21 is located under the plural keycaps 20 and connected with the plural connecting elements 23. The plural connecting elements 23 are located over the base plate 21, and connected with the base plate 21 and the corresponding keycaps 20. Since the keycap 20 is connected with the corresponding connecting element 23, the keycap 20 is moved relative to the base plate 21 when the keycap 20 is depressed.

The switch circuit board 22 is arranged between the plural keycaps 20 and the base plate 21. The elastic elements 24 are arranged between the corresponding keycaps 20 and the switch circuit board 22. When one of the plural keycaps 20 is depressed by the user, the keycap 20 is moved downwardly. As the keycap 20 is moved downwardly to push the elastic element 24, the switch circuit board 22 is triggered to generate a corresponding key signal. In an embodiment, the switch circuit board 22 is a membrane switch circuit board, and the elastic elements 24 are rubbery elastomers. The inner structure of the switch circuit board 22 comprises an upper wiring plate, a lower wiring plate and a separation layer. The upper wiring plate, the lower wiring plate and the separation layer are well known to those skilled in the art, and are not redundantly described herein.

Please refer to FIG. 3 again. The base plate 21 comprises plural base plate hooks 211. The plural base plate hooks 211 are disposed on a top surface of the base plate 21. The plural base plate hooks 211 are connected with the corresponding connecting elements 23.

The connecting element 23 comprises a first frame 231 and a second frame 232. A first end of the first frame 231 is connected with the keycap 20. A second end of the first frame 231 is connected with the corresponding base plate hooks 211 of the base plate 21. The second frame 232 is combined with the first frame 231. Moreover, the second frame 232 can be swung relative to the first frame 231. A first end of the second frame 232 is connected with the corresponding base plate hook 211 of the base plate 21. A second end of the second frame 232 is connected with the keycap 20. The first frame 231 comprises plural first connection shafts 2311. The plural first connection shafts 2311 are located at the first end of the first frame 231. The second frame 232 comprises plural second connection shafts 2321. The plural second connection shafts 2321 are located at the second end of the second frame 232. In this embodiment, the connecting element 23 is a scissors-type connecting element.

Figure 4:
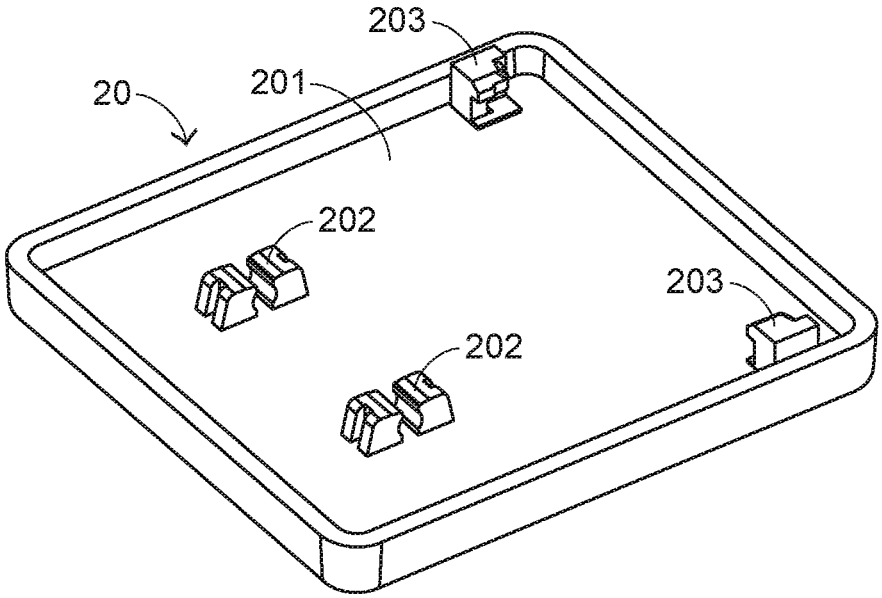
FIG. 4 is a schematic perspective view illustrating the keycap of the keyboard device according to the first embodiment of the present invention and taken along another viewpoint.

Please refer to FIGS. 3 and 4. FIG. 4 is a schematic perspective view illustrating the keycap of the keyboard device according to the first embodiment of the present invention and taken along another viewpoint. An inner surface 201 of the keycap 20 is shown in FIG. 4. The keycap 20 comprises plural elastic hooks 202 and plural open-type hooks 203. The plural elastic hooks 202 are disposed on the inner surface 201 of the keycap 20 and located at a first side of the keycap 20. The elastic hooks 202 are connected with the corresponding first connection shafts 2311 of the connecting element 23. Consequently, the first connection shafts 2311 are rotatable within the corresponding elastic hooks 202. The plural open-type hooks 203 are disposed on the inner surface 201 of the keycap 20 and located at a second side of the keycap 20. The open-type hooks 203 are connected with the corresponding second connection shafts 2321 of the connecting element 23. Consequently, the second connection shafts 2321 are rotatable within the corresponding open-type hooks 203. In this embodiment, the plural elastic hooks 202 are made of an elastic material, and the plural open-type hooks 203 and the keycaps 20 are made of a plastic material. Moreover, the plural elastic hooks 202 are formed on the inner surface 201 of the keycap 20 through at least one of a double injection process, a high-frequency welding process and an ultrasonic hot welding process.

A process of assembling the keycap 20 with the connecting element 23 will be described as follows. Firstly, the first connection shafts 2311 of the first frame 231 are introduced into the corresponding elastic hooks 202. Due to the elastic properties of the elastic hooks 202, the elastic hooks 202 are pushed by the corresponding first connection shafts 2311 and the elastic hooks 202 are subjected to elastic deformation. That is, the elastic hooks 202 are propped open. When the elastic hooks 202 are no longer pushed by the corresponding first connection shafts 2311, the elastic hooks 202 are restored to their original shapes in response to the elastic properties of the elastic hooks 202. Consequently, the elastic hooks 202 are engaged with the corresponding first connection shafts 2311.

Since the open-type hooks 203 are open to the outside, the second connection shafts 2321 of the second frame 232 can be easily engaged with the corresponding open-type hooks 203. The connecting element 23 is connected with the base plate 21 and the keycap 20 through the corresponding base plate hooks 211, the corresponding elastic hooks 202 and the corresponding open-type hooks 203. Consequently, the second frame 232 can be swung relative to the first frame 231. As the second frame 232 is swung relative to the first frame 231, the keycap 20 is moved upwardly or downwardly relative to the base plate 21.

The operation of depressing the keycap 20 will be described as follows. While one of the keycaps 20 is depressed by the user, the keycap 20 is moved downwardly relative to the base plate 21. Since the connecting element 23 is pushed by the keycap 20, the connecting element 23 is correspondingly swung. Moreover, as the keycap 20 is moved downwardly to push the elastic element 24, the elastic element 24 is subjected to deformation to trigger the switching circuit board 22. Consequently, the corresponding key signal is generated. When the keycap 20 is no longer depressed, the keycap 20 is moved upwardly relative to the base plate 21 in response to a restoring elastic force of the elastic element 24. As the keycap 20 is moved upwardly, the connecting element 23 is correspondingly swung and switched from the stacked state to the open-scissors state again. Consequently, the keycap 20 is returned to its original position.

As mentioned above, the elastic hooks 202 are made of the elastic material. In accordance with a feature of the present invention, the flexural modulus of the elastic material is higher than the flexural modulus of the plastic material. Consequently, during the process of assembling the keycap 20 with the connecting element 23, the elastic hooks 202 are subjected to restorable elastic deformation. Due to the restorable elastic deformation, the elastic hooks 202 are not damaged while the elastic hooks 202 are propped open by the corresponding first connection shafts 2311.

Figure 5:
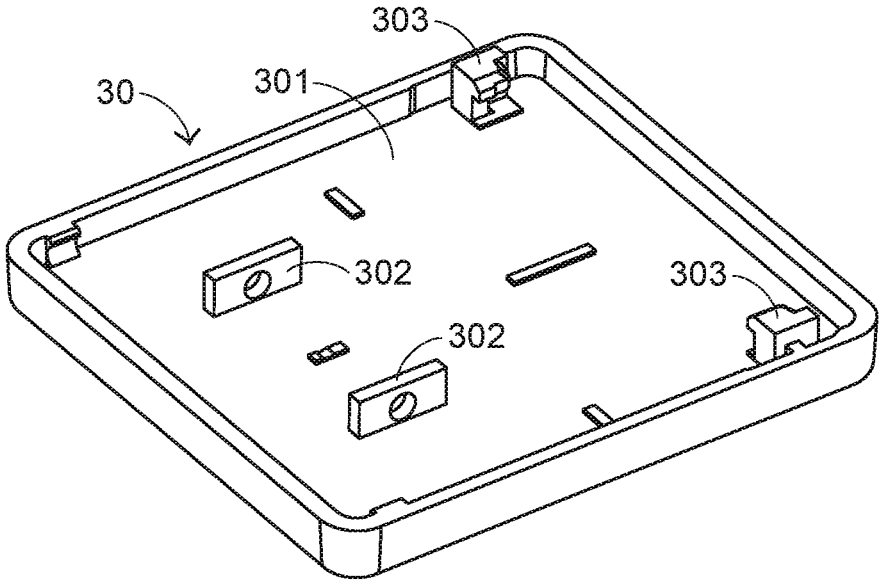
FIG. 5 is a schematic perspective view illustrating a keycap of a keyboard device according to a second embodiment of the present invention and taken along another viewpoint.

The present invention further comprises a second embodiment, which is distinguished from the first embodiment. FIG. 5 is a schematic perspective view illustrating a keycap of a keyboard device according to a second embodiment of the present invention and taken along another viewpoint. An inner surface 301 of the keycap 30 is shown in FIG. 5. The keycap 30 comprises plural elastic hooks 302 and plural open-type hooks 303. The plural elastic hooks 302 are disposed on the inner surface 301 of the keycap 30 and located at a first side of the keycap 30. The elastic hooks 302 are connected with the corresponding first connection shafts (not shown) of the connecting element (not shown). The plural open-type hooks 303 are disposed on the inner surface 301 of the keycap 30 and located at a second side of the keycap 30. The open-type hooks 303 are connected with the corresponding second connection shafts (not shown) of the connecting element (not shown). Except for the following items, the structure of the keycap 30 of this embodiment is substantially identical to the structure of the keycap 20 of the first embodiment. Firstly, the elastic hooks 302 are made of a metallic material. Moreover, the flexural modulus of the metallic material is higher than the flexural modulus of the plastic material. The operations of the keycap 30 and the structures of the other components of the keyboard device are substantially identical to those of the first embodiment, and are not redundantly described herein.

Figure 6:
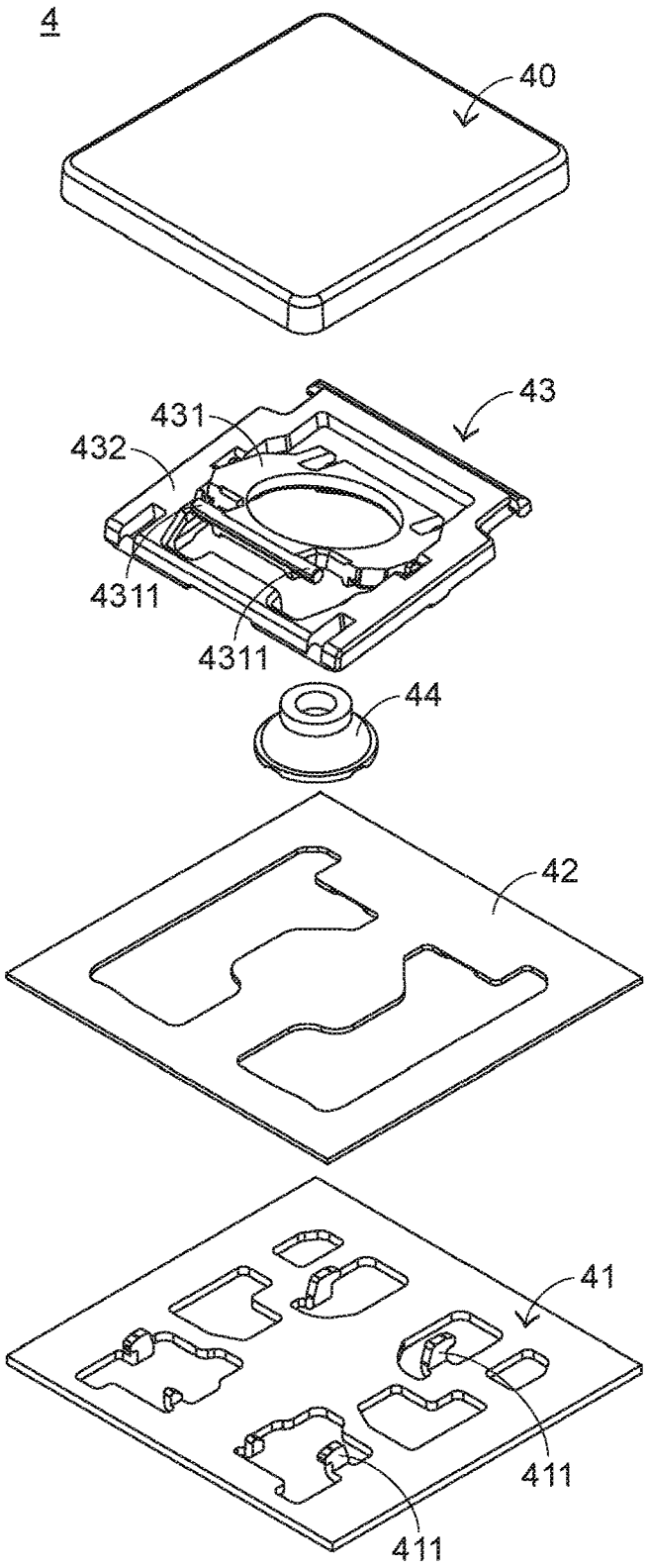
FIG. 6 is a schematic exploded view illustrating a keyboard device according to a third embodiment of the present invention.
Figure 7:
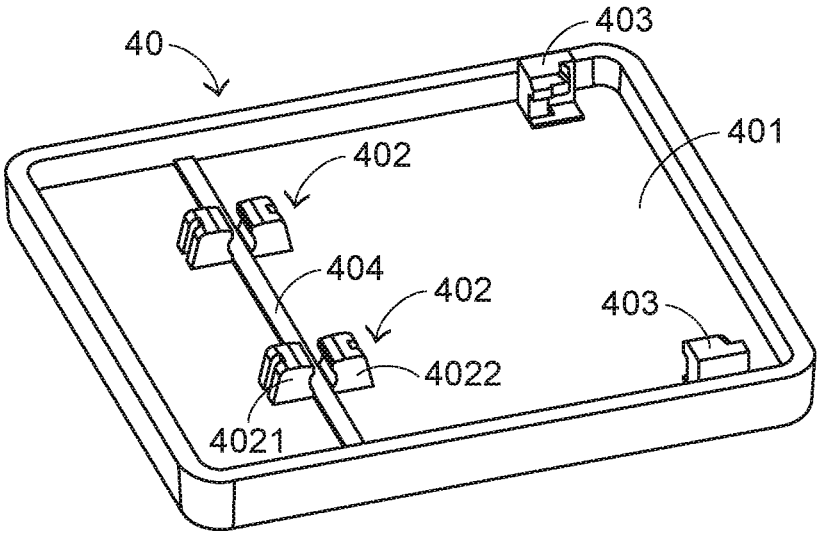
FIG. 7 is a schematic perspective view illustrating a keycap of a keyboard device according to the third embodiment of the present invention and taken along another viewpoint.

The present invention further comprises a third embodiment, which is distinguished from the above embodiment. FIG. 6 is a schematic exploded view illustrating a keyboard device according to a third embodiment of the present invention. FIG. 7 is a schematic perspective view illustrating a keycap of a keyboard device according to the third embodiment of the present invention and taken along another viewpoint. In this embodiment, the keyboard device 4 comprises plural keycaps 40, a base plate 41, a switching circuit board 42, plural connecting elements 43 and plural elastic elements 44. For succinctness, only one keycap 40, one connecting element 43 and one elastic element 44 are shown in the drawings. The base plate 41 comprises plural base plate hook 411. The connecting element 43 comprises a first frame 431 and a second frame 432. In comparison with the keyboard device 2, the structure of the keycap 40 of the keyboard device 4 of this embodiment is distinguished. The other components of the keyboard device 4 of this embodiment are substantially identical to those of the keyboard device 2, and are not redundantly described herein.

An inner surface 401 of the keycap 40 is shown in FIG. 7. The keycap 40 comprises plural hooks 402, plural open-type hooks 403 and an elastic structure 404. The elastic structure 404 is an elastic strip that is formed on the inner surface 401 of the keycap 40. The plural hooks 402 are disposed on the inner surface 401 of the keycap 40 and located at a first side of the keycap 40. The hooks 402 are connected with the corresponding first connection shafts 4311 of the connecting element 43. Consequently, the first connection shafts 4311 are rotatable within the corresponding hooks 402. Each hook 402 comprises a first hooking part 4021 and a second hooking part 4022. The first hooking part 4021 is disposed on the inner surface 401 of the keycap 40 and arranged beside a first side of the elastic structure 404. The first hooking part 4021 is contacted with the first frame 431 of the connecting element 43. The second hooking part 4022 is disposed on the inner surface 401 of the keycap 40 and arranged beside a second side of the elastic structure 404. The second hooking part 4022 is also contacted with the first frame 431 of the connecting element 43. In this embodiment, the keycap 40 is made of a plastic material, and the elastic structure 404 is made of an elastic material. Moreover, the elastic structure 404 is formed on the inner surface 401 of the keycap 40 through a double injection process.

A process of assembling the keycap 40 with the connecting element 43 will be described as follows. Firstly, the first connection shaft 4311 of the first frame 431 is introduced into the corresponding elastic hooks 402. That is, the first connection shaft 4311 of the first frame 431 is introduced into the space between the first hooking part 4021 and the second hooking part 4022. Meanwhile, the first hooking part 4021 and the second hooking part 4022 are pushed by the corresponding first connection shaft 4311. Due to the elasticity of the elastic structure 404 and the force of the first connection shaft 4311 acting on the first hooking part 4021, the elastic structure 404 is subjected to restorable elastic deformation. Meanwhile, the keycap 40 is bent along the elastic structure 404 and the first hooking part 4021 is moved away from the second hooking part 4022. Consequently, the first connection shaft 4311 of the first frame 431 is introduced into the space between the first hooking part 4021 and the second hooking part 4022. After the first connection shaft 4311 is introduced into the hook 402, the first hooking part 4021 and the second hooking part 4022 are not pushed by the corresponding first connection shaft 4311. Meanwhile, the keycap 40 is switched from the bent state to the original shape in response to the elastic properties of the elastic structure 404. Consequently, the first hooking part 4021 and the second hooking part 4022 are engaged with both sides of the first connection shaft 4311. Under this circumstance, the first connection shaft 4311 and the hook 402 are engaged with each other.

As mentioned above, the elastic structure 404 is made of the elastic material. Moreover, the flexural modulus of the elastic material is higher than the flexural modulus of the plastic material. During the process of assembling the keycap 40 with the connecting element 43, the keycap 40 is bent in response to the restorable elastic deformation of the elastic structure 404. Consequently, the first hooking part 4021 or the second hooking part 4022 is not damaged when pushed by the first connection shaft 4311.

From the above descriptions, the present invention provides a keyboard device. The keyboard device has an elastic hook or an elastic structure that is made of an elastic material. The elastic hook or the elastic structure is installed on an inner surface of a keycap. While the keycap is assembled with a connecting element, the elastic hook or the elastic structure is subjected to elastic deformation in response to the elasticity of the elastic hook or the elastic structure. Consequently, the structure of the keycap is not damaged.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a base plate;

a connecting element located over the base plate and connected with the base plate; and a keycap exposed outside the keyboard device and connected with the connecting element, wherein the keycap comprises an elastic hook that is connected with the connecting element, and the elastic hook is made of an elastic material, wherein the connecting element comprises:

a first frame, wherein a first end of the first frame is connected with the elastic hook, and a second end of the first frame is connected with the base plate; and a second frame combined with the first frame and swung relative to the first frame, wherein a first end of the second frame is connected with the base plate, and a second end of the second frame is connected with an open-type hook of the keycap.

2. The keyboard device according to claim 1, wherein the keycap is made of a plastic material, and the elastic hook is formed on an inner surface of the keycap through at least one of a double injection process, a high-frequency welding process and an ultrasonic hot welding process.

3. The keyboard device according to claim 1, wherein the base plate comprises plural base plate hooks, and the plural base plate hooks are installed on a top surface of the base plate, wherein each of the plural base plate hooks is connected with the second end of the first frame or the first end of the second frame.

4. The keyboard device according to claim 1, further comprising:

a switch circuit board located under the keycap, wherein as the keycap is moved to trigger the switch circuit board, the switch circuit board generates a key signal; and an elastic element arranged between the keycap and the switch circuit board, wherein as the keycap is moved downwardly to push the elastic element, the elastic element triggers the switch circuit board, wherein when the elastic element is not pushed by the keycap, the elastic element provides an elastic force to the keycap.

5. A keyboard device, comprising:

a base plate;

a connecting element located over the base plate and connected with the base plate; and a keycap exposed outside the keyboard device and connected with the connecting element, wherein the keycap comprises:

an elastic structure hook installed on an inner surface of the keycap;

a first hooking part installed on the inner surface of the keycap and arranged beside a first side of the elastic structure, wherein the first hooking part is contacted with the connecting element; and a second hooking part installed on the inner surface of the keycap and arranged beside a second side of the elastic structure, wherein the second hooking part is contacted with the connecting element, wherein the keycap is bent in response to elasticity of the elastic structure, so that the first hooking part is moved away from the second hooking part.

6. The keyboard device according to claim 5, wherein the keycap is made of a plastic material, and the elastic structure is made of an elastic material, wherein the elastic structure is formed on the inner surface of the keycap through a double injection process.

7. The keyboard device according to claim 5, further comprising:

a switch circuit board located under the keycap, wherein as the keycap is moved to trigger the switch circuit board, the switch circuit board generates a key signal; and an elastic element arranged between the keycap and the switch circuit board, wherein as the keycap is moved downwardly to push the elastic element, the elastic element triggers the switch circuit board, wherein when the elastic element is not pushed by the keycap, the elastic element provides an elastic force to the keycap.

8. The keyboard device according to claim 5, wherein the connecting element comprises:

a first frame, wherein a first end of the first frame is connected with the first hooking part and the second hooking part, and a second end of the first frame is connected with the base plate; and a second frame combined with the first frame and swung relative to the first frame, wherein a first end of the second frame is connected with the base plate, and a second end of the second frame is connected with an open-type hook of the keycap.

9. The keyboard device according to claim 8, wherein the base plate comprises plural base plate hooks, and the plural base plate hooks are installed on a top surface of the base plate, wherein each of the plural base plate hooks is connected with the second end of the first frame or the first end of the second frame.

* * * * *